US010782074B2

(12) United States Patent
Miller et al.

(10) Patent No.: US 10,782,074 B2
(45) Date of Patent: Sep. 22, 2020

(54) HEAT EXCHANGER WITH A COOLING MEDIUM BAR

(71) Applicant: API Heat Transfer, Inc., Buffalo, NY (US)

(72) Inventors: Ian T. Miller, Coventry (GB); Nathan L. Sieger, Oak Creek, WI (US)

(73) Assignee: API Heat Transfer, Inc., Buffalo, NY (US)

( * ) Notice: Subject to any disclaimer, the term of this patent is extended or adjusted under 35 U.S.C. 154(b) by 65 days.

(21) Appl. No.: 16/163,980

(22) Filed: Oct. 18, 2018

(65) Prior Publication Data

US 2019/0120564 A1 Apr. 25, 2019

Related U.S. Application Data

(60) Provisional application No. 62/574,853, filed on Oct. 20, 2017.

(51) Int. Cl.
*F28D 9/00* (2006.01)
*F28F 3/02* (2006.01)
(Continued)

(52) U.S. Cl.
CPC ..... *F28D 9/0056* (2013.01); *F28D 1/0366* (2013.01); *F28D 1/05391* (2013.01); *F28D 9/0062* (2013.01); *F28F 1/022* (2013.01); *F28F 3/025* (2013.01); *F28D 2021/008* (2013.01); *F28F 2240/00* (2013.01); *F28F 2275/04* (2013.01)

(58) Field of Classification Search
CPC .... F28F 3/005; F28F 3/025; F28F 3/06; F28F 3/08; F28F 2220/00; F28F 2230/00; F28F 2240/00; F28F 2265/16; F28F 2265/26; F28D 1/0233; F28D 1/05383; F28D 1/05358; F28D 1/05366; F28D 9/0037; F28D 9/0062; F28D 9/02; F28D 1/0308; F28D 1/0316; F28D 1/0366
See application file for complete search history.

(56) References Cited

U.S. PATENT DOCUMENTS 1,559,180 A 8/1925 Prat
1,601,637 A 9/1926 Meigs
(Continued)

FOREIGN PATENT DOCUMENTS

CN 1125306 C 10/2003
CN 1246118 C 3/2006
(Continued)

*Primary Examiner* — Jianying C Atkisson
*Assistant Examiner* — Jose O Class-Quinones
(74) *Attorney, Agent, or Firm* — Marshall & Melhorn, LLC

(57) ABSTRACT

A heat exchanger includes one or more hot medium flow regions and one or more cooling medium flow regions. Hot medium bars border the one or more hot medium flow regions and cooling medium bars border the one or more cooling medium flow regions. At least one cooling medium bar of the cooling medium bars is joined to a pair of partition sheets. The at least one cooling medium bar includes a base, a first leg, and a second leg. The first leg and the second leg each extend from the base. A cavity is provided between the first leg and the second leg. The cavity is in fluid communication with a first cooling medium flow region of the one or more cooling medium flow regions via an opening provided between the first leg and the second leg.

13 Claims, 4 Drawing Sheets

(51) Int. Cl.

| | |
|---|---|
| ***F28D 1/03*** | (2006.01) |
| ***F28D 1/053*** | (2006.01) |
| ***F28F 1/02*** | (2006.01) |
| ***F28D 21/00*** | (2006.01) |

(56) References Cited

U.S. PATENT DOCUMENTS

| | | | |
|---|---|---|---|
| 1,930,879 | A | 10/1933 | Rosenblad |
| 2,952,445 | A | 9/1960 | Ladd |
| 3,151,676 | A | 8/1961 | Otto et al. |
| 3,140,538 | A | 7/1964 | Rutledge |
| 3,305,010 | A | 2/1967 | Campbell |
| 3,517,731 | A | 6/1970 | Rothman |
| 3,542,124 | A | 11/1970 | Manfredo et al. |
| 4,434,845 | A | 3/1984 | Steeb |
| 4,574,878 | A | 3/1986 | Sugiyama et al. |
| 4,729,428 | A | 3/1988 | Yasutake et al. |
| 4,804,041 | A | 2/1989 | Hasegawa et al. |
| 4,934,455 | A | 6/1990 | Hasegawa |
| 4,966,231 | A | 10/1990 | Belcher et al. |
| 5,183,106 | A | 2/1993 | Stencliffe et al. |
| 5,564,496 | A | 10/1996 | Blum et al. |
| 5,584,341 | A | 12/1996 | Sabin et al. |
| 6,019,169 | A | 2/2000 | Ruppel et al. |
| 6,446,710 | B2 | 9/2002 | Beeck et al. |
| 6,446,713 | B1 | 9/2002 | Insalaco |
| 6,520,252 | B1 | 2/2003 | Bizzarro |
| 6,640,887 | B2 | 11/2003 | Abell et al. |
| 6,670,050 | B2 | 12/2003 | Raybould et al. |
| 6,951,245 | B1 | 10/2005 | Lehman |
| 7,219,719 | B2 | 5/2007 | Gerard |
| 7,243,707 | B2 | 7/2007 | Brost et al. |
| 7,438,121 | B2 | 10/2008 | Minami et al. |
| 7,631,688 | B2 | 12/2009 | Brost et al. |
| 8,047,272 | B2 | 11/2011 | Whittenberger et al. |
| 8,129,036 | B2 | 3/2012 | Berginger et al. |
| 8,261,816 | B2 | 9/2012 | Ambros et al. |
| 3,276,654 | A1 | 10/2012 | Zaffetti et al. |
| 8,424,592 | B2 | 4/2013 | Meshenky et al. |
| 8,522,862 | B2 | 9/2013 | Opferkuch et al. |
| 8,579,021 | B2 | 11/2013 | Kuhne et al. |
| 8,590,606 | B2 | 11/2013 | Arai et al. |
| 8,656,986 | B2 | 2/2014 | Yuan et al. |
| 8,689,858 | B2 | 4/2014 | Rothenhofer et al. |
| 8,881,797 | B2 | 11/2014 | Melo et al. |
| 9,279,626 | B2 | 3/2016 | Berukhim et al. |
| 9,403,204 | B2 | 8/2016 | Casterton et al. |
| 2002/0023743 | A1 | 2/2002 | Jung et al. |
| 2006/0254758 | A1 | 11/2006 | Matsuzaki et al. |
| 2006/0260790 | A1 | 11/2006 | Theno et al. |
| 2008/0210415 | A1 | 9/2008 | Crayssac et al. |
| 2010/0243224 | A1 | 9/2010 | Jianlong et al. |
| 2011/0315362 | A1 | 12/2011 | Jiang et al. |
| 2012/0073793 | A1 | 3/2012 | Kuehne et al. |
| 2012/0175096 | A1 | 7/2012 | Hakamata et al. |
| 2012/0211215 | A1 | 8/2012 | Ishihuro et al. |
| 2013/0140010 | A1 | 6/2013 | Parfenov |
| 2014/0290920 | A1 | 10/2014 | Ouradnik et al. |
| 2014/0299301 | A1 | 10/2014 | Dumoutier et al. |
| 2016/0054067 | A1 | 2/2016 | Dandan et al. |
| 2016/0216039 | A1 | 7/2016 | Bergin et al. |

FOREIGN PATENT DOCUMENTS

| | | | |
|---|---|---|---|
| CN | 1288415 | C | 12/2006 |
| CN | 101178292 | A | 5/2008 |
| CN | 101523145 | A | 9/2009 |
| CN | 201382708 | Y | 1/2010 |
| CN | 101650141 | A | 2/2010 |
| CN | 100595509 | C | 3/2010 |
| CN | 101672597 | A | 3/2010 |
| CN | 101672598 | A | 3/2010 |
| CN | 101782341 | A | 7/2010 |
| CN | 201583161 | U | 9/2010 |
| CN | 101886885 | A | 11/2010 |
| CN | 201772791 | U | 3/2011 |
| CN | 102062557 | A | 5/2011 |
| CN | 201945218 | U | 8/2011 |
| CN | 202267392 | U | 6/2012 |
| CN | 1030974848 | B | 5/2013 |
| CN | 103185475 | A | 7/2013 |
| CN | 203100499 | U | 7/2013 |
| CN | 203249521 | U | 10/2013 |
| CN | 103403484 | A | 11/2013 |
| CN | 103502761 | A | 1/2014 |
| CN | 203489749 | U | 3/2014 |
| CN | 203642752 | U | 6/2014 |
| CN | 203744815 | U | 7/2014 |
| CN | 104075591 | A | 10/2014 |
| CN | 105387735 | A | 3/2016 |
| CN | 105387742 | A | 3/2016 |
| DE | 2020080133351 | U1 | 3/2010 |
| DE | 202011052186 | U1 | 3/2013 |
| DE | 20208748 | U1 | 11/2013 |
| DE | 102014001575 | A1 | 10/2014 |
| EP | 3034978 | A1 | 6/2016 |
| WO | 9854531 | A1 | 12/1998 |
| WO | 2015105261 | A1 | 7/2015 |
| WO | 2016066771 | A1 | 5/2016 |

HEAT EXCHANGER WITH A COOLING MEDIUM BAR

CROSS-REFERENCE TO RELATED APPLICATION

This application is claiming the benefit, under 35 U.S. C. 119(e), of the U.S. provisional patent application which was granted Ser. No. 62/574,853 and filed on Oct. 20, 2017, the entire disclosure of which is hereby incorporated by reference.

BACKGROUND

The invention relates to a heat exchanger. More particularly, the invention relates to a bar and plate type heat exchanger.

Heat exchangers of the bar and plate variety are known. Such heat exchangers may be exposed to high thermal and mechanical loads caused by thermal and/or pressure cycles. These conditions can lead to stresses. Over time, such stresses can result in the formation of cracks in the areas where the bars and plates are joined together. The formation of cracks in such areas can lead to leaks in the heat exchanger and a decrease in the efficiency of the heat exchanger.

It would be desirable to provide a heat exchanger that can resist the formation of cracks in the areas where its components are joined together when it is exposed to the conditions described above.

BRIEF SUMMARY

Embodiments of a heat exchanger are provided. In an embodiment, the heat exchanger comprises one or more hot medium flow regions and one or more cooling medium flow regions. Hot medium bars border the one or more hot medium flow regions and cooling medium bars border the one or more cooling medium flow regions. At least one cooling medium bar of the cooling medium bars is joined to a pair of partition sheets. The at least one cooling medium bar comprises a base, a first leg, and a second leg. The first leg and the second leg each extend from the base. A cavity is provided between the first leg and the second leg. The cavity is in fluid communication with a first cooling medium flow region of the one or more cooling medium flow regions via an opening provided between the first leg and the second leg. The cavity is at least partially defined by an inner end portion adjoining a first wall portion and a second wall portion. The inner end portion has an inner end portion curved surface. The first wall portion has a first wall portion planar surface. The second wall portion has a second wall portion planar surface. The first wall portion adjoins a third wall portion and the second wall portion adjoins a fourth wall portion. The third wall portion has a third wall portion curved surface and the fourth wall portion has a fourth wall portion curved surface. The third wall portion adjoins a fifth wall portion and the fourth wall portion adjoins a sixth wall portion. The fifth wall portion and the sixth wall portion at least partially define the opening.

BRIEF DESCRIPTION OF THE SEVERAL VIEWS OF THE DRAWING

The above, as well as other advantages of the present invention will become readily apparent to those skilled in the art from the following detailed description when considered in the light of the accompanying drawings in which.

DETAILED DESCRIPTION

Figure 1:
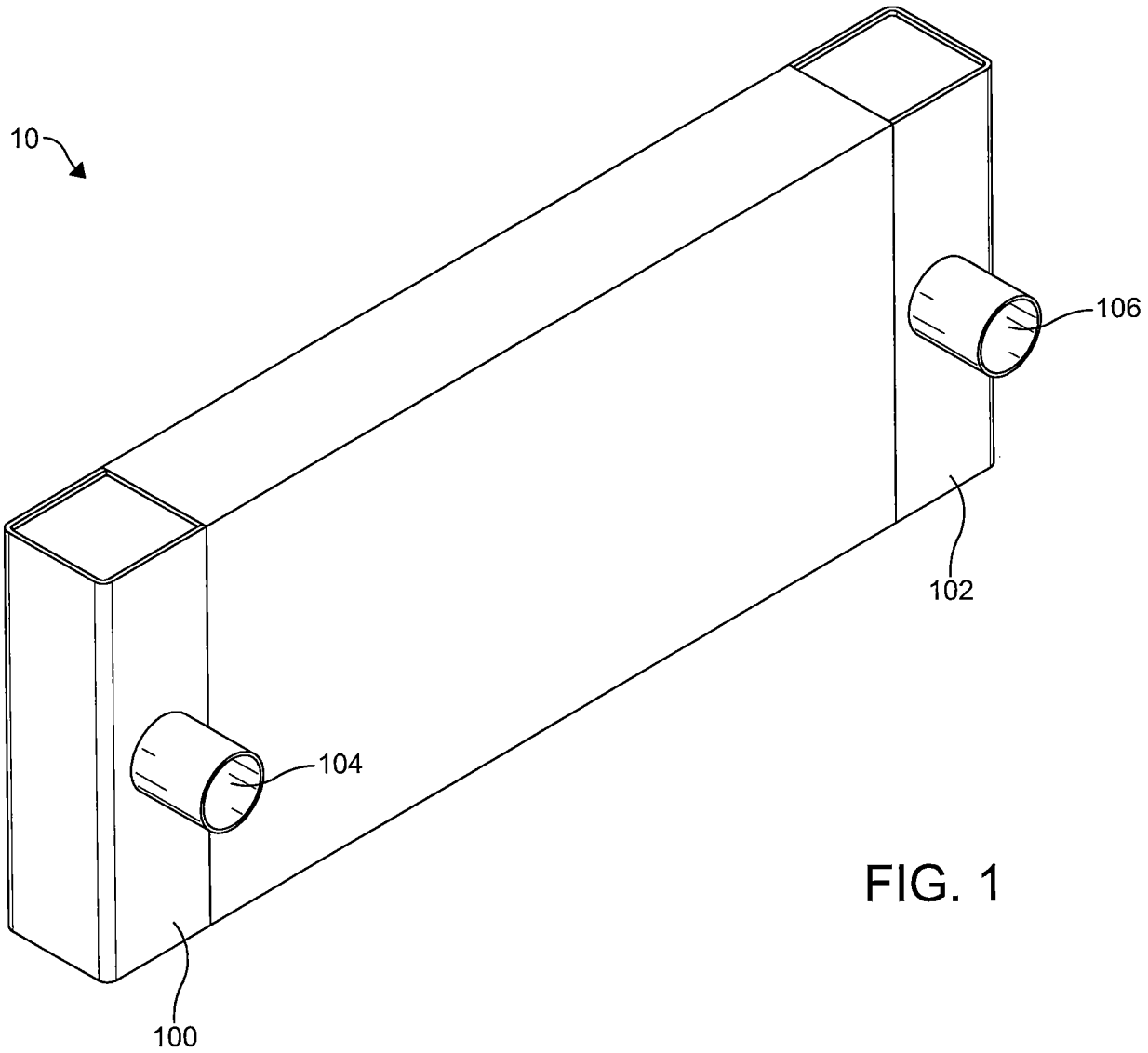
FIG. 1 is a perspective view of a heat exchanger in accordance with the invention.
Figure 2:
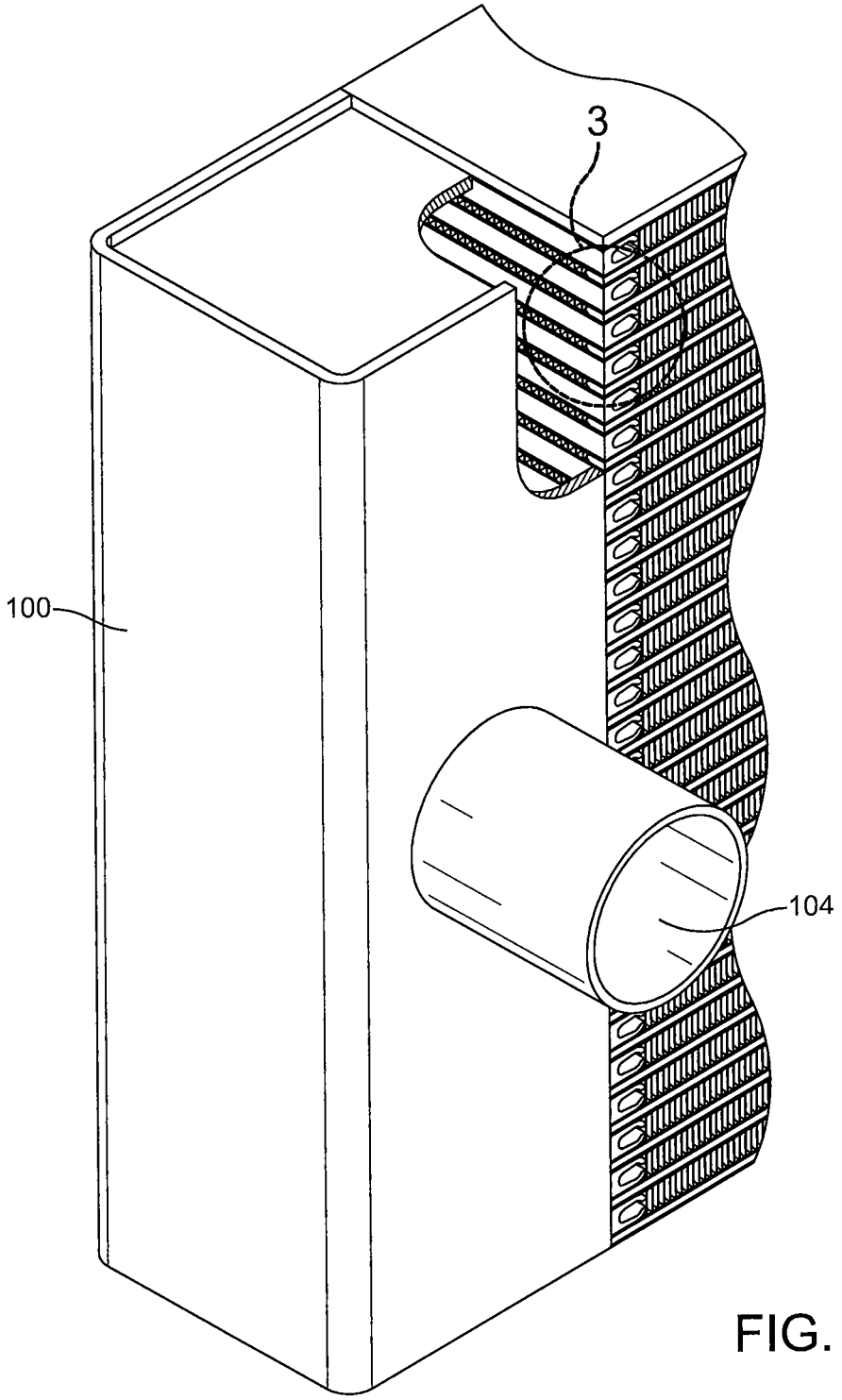
FIG. 2 is an enlarged partial perspective view showing selected portions of the heat exchanger of FIG. 1.

It is to be understood that the invention may assume various alternative orientations and step sequences, except where expressly specified to the contrary. It is also to be understood that the specific assemblies, devices, and features illustrated in the attached drawings, and described in the following specification are simply exemplary embodiments of the inventive concepts. Hence, specific dimensions, directions, or other physical characteristics relating to the embodiments disclosed are not to be considered as limiting, unless expressly stated otherwise. Also, although they may not be, like elements found in the aforementioned embodiments may be referred to with like identifiers within this section of the application.

Embodiments of a heat exchanger 10 are described herein and are illustrated in FIGS. 1-5. The heat exchanger 10 may have applications in a vehicle as a radiator, charge-air cooler, or oil cooler. However, it should also be appreciated that the heat exchanger 10 may have other applications.

The heat exchanger 10 comprises one or more hot medium flow regions 12, 12*a*, 12*b*, 12*c*. Preferably, when a plurality of hot medium flow regions 12, 12*a*, 12*b*, 12*c* are provided, the hot medium flow regions 12, 12*a*, 12*b*, 12*c* are in a spaced apart and parallel relationship with each other. When the heat exchanger 10 is in use, a hot medium or fluid flows in each hot medium flow region 12, 12*a*, 12*b*, 12*c*. The hot medium may be a liquid such as, for example, a coolant or oil or a gas such as, for example, air.

The heat exchanger 10 utilizes a cooling medium to cool the hot medium. Preferably, the cooling medium is air. However, it should be appreciated that the cooling medium may be another fluid. The cooling medium flows in one or more cooling medium flow regions 14, 14*a*, 14*b*. Preferably, when a plurality of cooling medium flow regions 14, 14*a*, 14*b* are provided, the cooling medium flow regions 14, 14*a*, 14*b* are in a spaced apart and parallel relationship with each other.

In certain embodiments, the heat exchanger 10 may be of the one-pass variety. In one such embodiment, the hot medium flow regions 12, 12*a*, 12*b*, 12*c* and cooling medium flow regions 14, 14*a*, 14*b* are positioned between an inlet tank 100 and an outlet tank 102. In this embodiment, the hot medium flow regions 12, 12*a*, 12*b*, 12*c* extend between and are in fluid communication with the inlet tank 100 and the outlet tank 102. The hot medium is received in the inlet tank 100 via an inlet 104. The inlet tank 100 is in fluid communication with the inlet 104. The inlet 104 is provided to receive the hot medium and direct the hot medium to the inlet tank 100. The inlet tank 100 directs the hot medium to the hot medium flow regions 12, 12*a*, 12*b*, 12*c*. From the hot medium flow regions 12, 12*a*, 12*b*, 12*c*, the hot medium is directed to the outlet tank 102. The outlet tank 102 is in fluid communication with an outlet 106. The outlet 106 is provided to receive the hot medium from the outlet tank 102 and direct the hot medium away from the outlet tank 102.

In other embodiments (not depicted), the heat exchanger may be of the two-pass variety. In one such embodiment, the hot medium flow regions 12, 12*a*, 12*b*, 12*c* and cooling medium flow regions 14, 14*a*, 14*b* may be positioned between a tank (not depicted) and a manifold (not depicted). In this embodiment, the tank may comprise an inlet and an outlet. Also, in this embodiment, the hot medium flow regions 12, 12*a*, 12*b*, 12*c* extend between and are in fluid communication with the tank and the manifold. The tank receives the hot medium at the inlet and directs the hot medium to the hot medium flow regions 12, 12*a*, 12*b*, 12*c*. From the hot medium flow regions 12, 12*a*, 12*b*, 12*c*, the hot medium is received by the manifold. After the hot medium has been received by the manifold, the hot medium is directed back through the heat exchanger to the outlet of the tank.

Preferably, the hot medium flow regions 12, 12*a*, 12*b*, 12*c* and cooling medium flow regions 14, 14*a*, 14*b* are in a perpendicular relationship with each other. The orientation of the hot medium flow regions 12, 12*a*, 12*b*, 12*c* and cooling medium flow regions 14, 14*a*, 14*b* allows the hot medium to flow in a first direction and the cooling medium to flow in a second direction. Preferably, the first direction and the second direction are different.

Further, in some embodiments, the hot medium flow regions 12, 12*a*, 12*b*, 12*c* and cooling medium flow regions 14, 14*a*, 14*b* are provided in an alternating arrangement. For example, when the hot medium flow regions 12, 12*a*, 12*b*, 12*c* comprise a first hot medium flow region 12*a* and a second hot flow medium flow region 12*b*, a first cooling medium flow region 14*a* is provided between the first hot medium flow region 12*a* and the second hot flow medium flow region 12*b*. In this embodiment, the first hot medium flow region 12*a* and the second hot flow medium flow region 12*b* are in a spaced apart and parallel relationship with each other.

Figure 3:
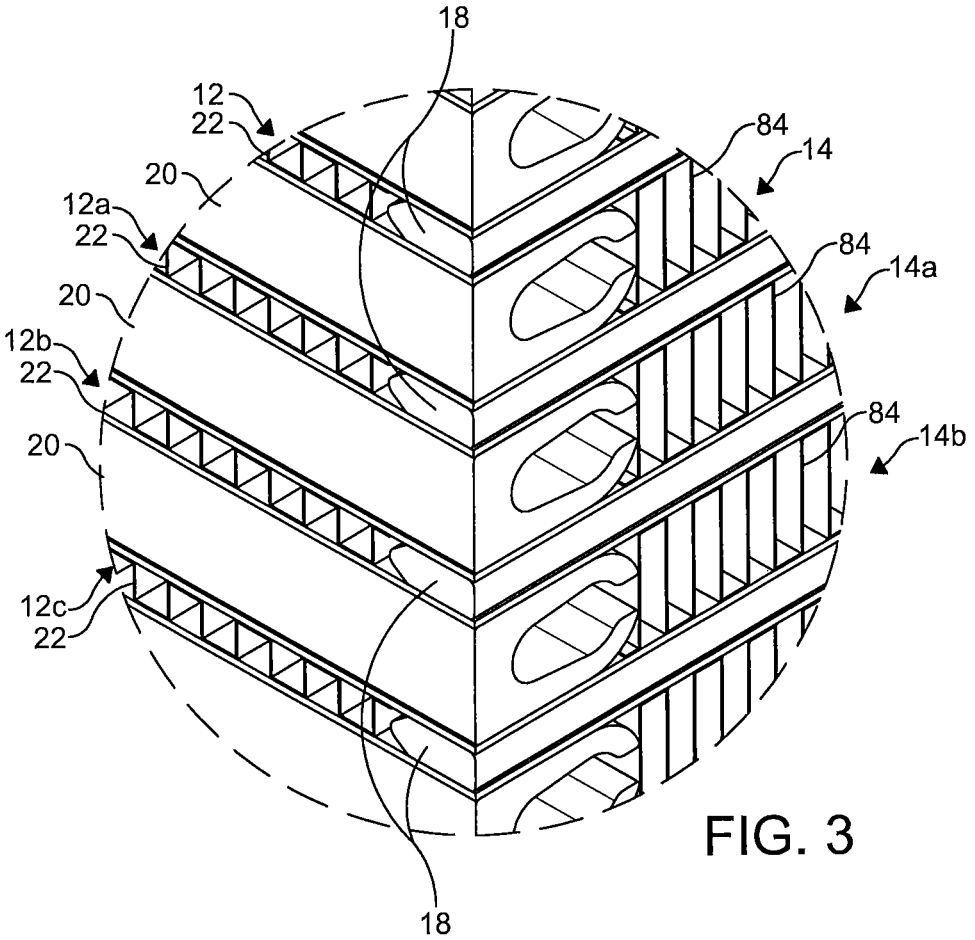
FIG. 3 is an enlarged view of a portion of FIG. 2.
Figure 4:
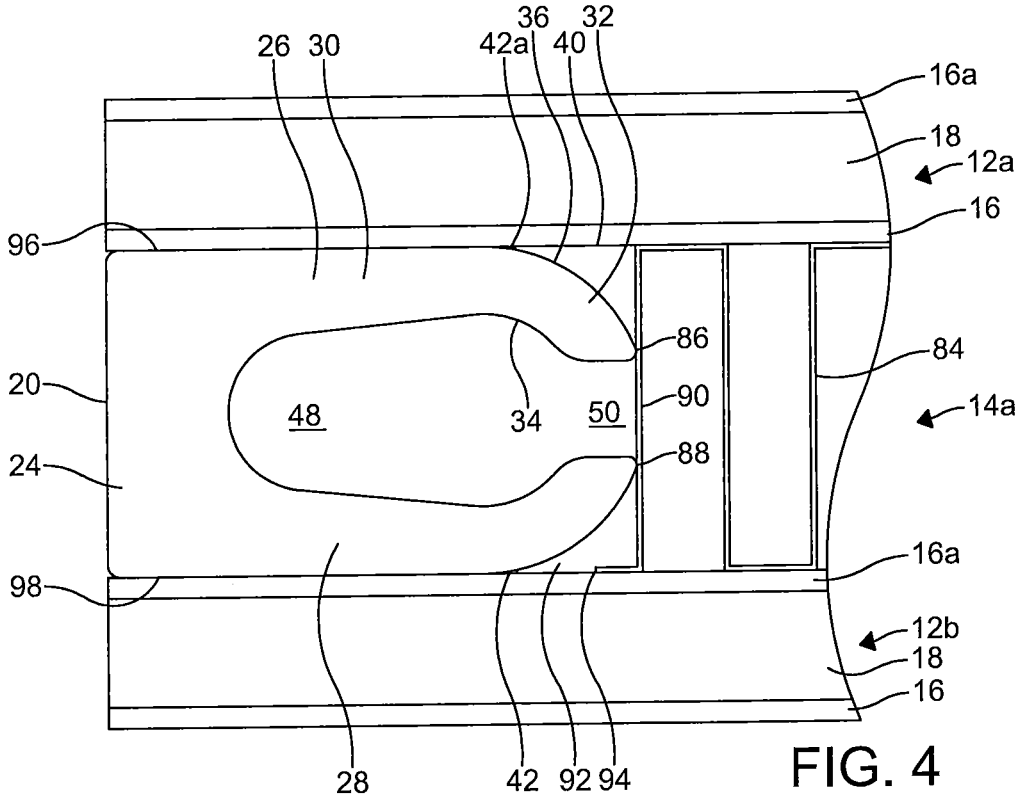
FIG. 4 is an enlarged view of a portion of FIG. 3.

As illustrated best in FIGS. 3-4, a partition sheet 16, 16*a* separates a hot medium flow region 12, 12*a*, 12*b*, 12*c* from a cooling medium flow region 14, 14*a*, 14*b*. Preferably, each partition sheet 16, 16*a* is relatively thin and comprises aluminum or an aluminum alloy. In an embodiment, one or more of the partition sheets 16, 16*a* also comprise a coating of brazing material on each major surface thereof. Preferably, each partition sheet 16, 16*a* comprises a coating of brazing material on each major surface thereof. The coating of brazing material is utilized to join each partition sheet 16, 16*a* to a hot medium bar 18 and a cooling medium bar 20 during a brazing process.

An end sheet (not depicted) is located at each end of the heat exchanger 10. Each end sheet is joined to a partition sheet 16, 16*a*. In an embodiment, the end sheets are each of a thickness that is greater than the thickness of the partition sheets 16, 16*a*. The end sheets may each comprise aluminum or an aluminum alloy.

It is preferred that one or more hot medium bars 18 border each hot medium flow region 12, 12*a*, 12*b*, 12*c*. Preferably, a pair of hot medium bars 18 border each hot medium flow region 12, 12*a*, 12*b*, 12*c* on opposite sides thereof. In an embodiment, the hot medium flow regions 12, 12*a*, 12*b*, 12*c* are also bordered by a pair of partition sheets 16, 16*a*. In this embodiment, each hot medium bar 18 may be joined to a pair of partition sheets 16, 16*a*. The one or more hot medium bars 18 assist in spacing the partition sheets 16, 16*a* from each other.

Each hot medium bar 18 may be of solid construction and may comprise aluminum or an aluminum alloy. In an embodiment, which is illustrated best in FIG. 3, one or more of the one or more hot medium bars 18 have a generally rectangular portion attached to a tapered portion. The tapered portion extends toward a respective hot medium flow region 12, 12*a*, 12*b*, 12*c* and may be of a generally triangular shape. Preferably, each hot medium bar 18 is configured in a similar manner and as described above. However, the hot medium bars 18 may be of any configuration known in the art.

It is preferred that a hot medium fin 22 is located within each hot medium flow region 12, 12*a*, 12*b*, 12*c*. The hot medium fins 22 help support the partition sheets 16, 16*a* and increase the heat transfer rate between the cooling medium and the hot medium. Each hot medium fin 22 may comprise aluminum or an aluminum alloy. Preferably, each hot medium fin 22 is corrugated. However, the hot medium fins may be of another configuration known in the art.

It is preferred that one or more cooling medium bars 20 border each cooling medium flow region 14, 14*a*, 14*b*. Preferably, a pair of cooling medium bars 20 border each cooling medium flow region 14, 14*a*, 14*b* on opposite sides thereof. Each cooling medium bar 20 may comprise aluminum or an aluminum alloy. It is preferred that each cooling medium flow region 14, 14*a*, 14*b* is also bordered by a pair of partition sheets 16, 16*a*. In an embodiment, each cooling medium bar 20 may be joined to a pair of partition sheets 16, 16*a*. The cooling medium bars 20 assist in spacing the partition sheets 16, 16*a* from each other.

For describing certain embodiments of the heat exchanger 10, only the cooling medium bar 20 illustrated in FIGS. 4-5 will be described below. It should be appreciated that the embodiments of the cooling medium bar 20 described below could be utilized to configure the remaining cooling medium bars in the heat exchanger 10. In some embodiments, it may be preferred each cooling medium bar 20 in the heat exchanger 10 is similarly configured.

Also, the cooling medium bar 20 illustrated in FIGS. 4-5 will be described with reference to the first cooling medium flow region 14*a*. Thus, only the first cooling medium flow region 14*a* will be described below. It should be appreciated that the embodiments of the first cooling medium flow region 14*a* described below could be utilized to configure the remaining cooling medium flow regions 14, 14*b* in the heat exchanger 10. In some embodiments, it may be preferred that each cooling medium flow region 14, 14*a*, 14*b* is similarly configured.

Referring now to FIG. 4, the cooling medium bar 20 borders the first cooling medium flow region 14*a*. The cooling medium bar 20 is joined to a pair of partition sheets 16, 16*a*. As illustrated, the cooling medium bar 20 comprises a base 24, a first leg 26, and a second leg 28. In some embodiments, the base 24 comprises a first surface 96 and a second surface 98. Preferably, the first surfaces 96 and the second surface 98 are provided in a parallel relationship with each other. The first leg 26 and the second leg 28 each extend from the base 24. Preferably, the first leg 26 and the second leg 28 extend in the same direction and toward the first cooling medium flow region 14*a*.

As illustrated, the first leg 26 and the second leg 28 may be similarly configured. Thus, for describing certain embodiments, only the portions 30, 32 of the first leg 26 will be referred to below. It should be appreciated that the second leg 28 may comprise portions that are not explicitly mentioned below and are configured in a manner which is similar to the portions 30, 32 of the first leg 26 described below.

Figure 5:
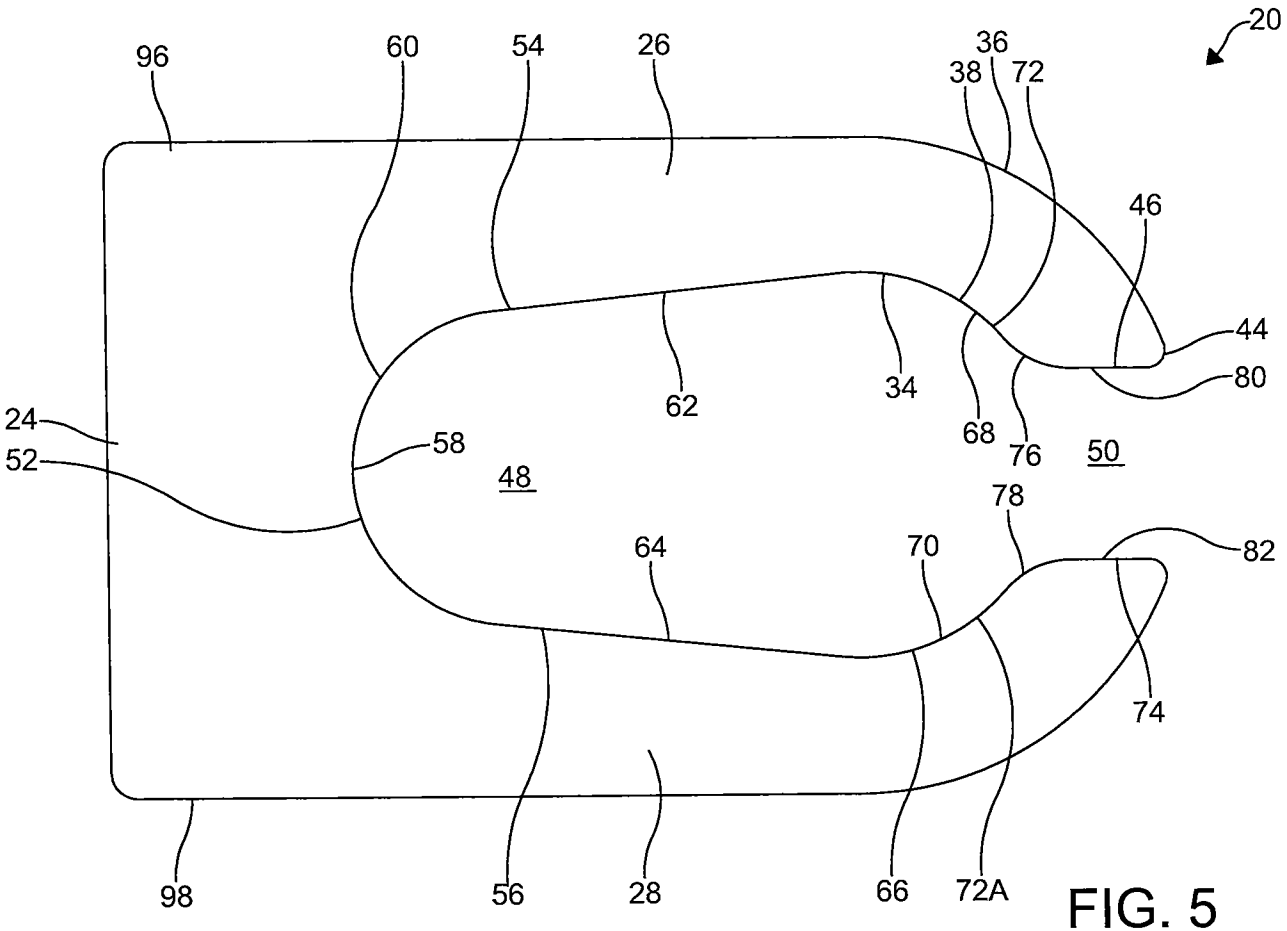
FIG. 5 is a front view of an embodiment of a cooling medium bar utilized in the heat exchanger of FIG.1.

Referring now to FIGS. 4-5, in an embodiment, the first leg 26 comprises a first portion 30 and a second portion 32. In this embodiment, the first portion 30 is attached to the base 24 on an end thereof and the second portion 32 on an opposite end thereof. It is preferred that the first portion 30 gradually decreases in thickness toward the first cooling medium flow region 14*a* and that the second portion 32 has a constant thickness. In an embodiment, the second portion 32 comprises an inner surface 34 and a curved outer surface 36. The inner surface 34 is at least partially defined by a third wall portion 38. As illustrated best in FIG. 4, the curved outer surface 36 faces a first surface 40 of a partition sheet 16. Preferably, the curved outer surface 36 is joined to the first surface 40 of the first partition plate 16 by a joint 42*a*. Preferably, the joint 42*a* is formed by a brazing process. However, it should be appreciated that other process may be utilized to form the joint. In certain embodiments, it may be preferred that the second portion 32 also comprises a transition surface 44. The transition surface 44 may be curved or sharply defined. In an embodiment, the transition surface 44 separates the curved outer surface 36 from another portion 46 of the first leg 26. Preferably, the transition surface 44 separates the curved outer surface 36 from a fifth wall portion 46.

A cavity 48 is provided between the first leg 26 and the second leg 28. The cavity 48 is in fluid communication with the first cooling medium flow region 14*a* via an opening 50 provided between the first leg 26 and the second leg 28. A first portion of the cavity 48 may gradually increase in thickness from an inner end portion 52 toward the opening 50 and a second portion of the cavity 48, adjacent the opening 50, may gradually increase in thickness from the opening 50 toward the inner end portion 52. The second portion of the cavity 48 separates the first portion from the opening 50.

The cavity 48 is at least partially defined by the inner end portion 52. The inner end portion 52 adjoins a first wall portion 54 and a second wall portion 56. The inner end portion 52 has an inner end portion curved surface 58. The inner end portion curved surface 58 comprises a first radius of curvature 60.

The first wall portion 54 has a first wall portion planar surface 62. The second wall portion 56 has a second wall portion planar surface 64. Preferably, the first wall portion planar surface 62 and the second wall portion planar surface 64 extend away from the inner end portion curved surface 58 toward the first cooling medium flow region 14*a*. Further, in some embodiments, the first wall portion planar surface 62 and the second wall portion planar surface 64 diverge from each other. Preferably, the first wall portion planar surface 62 and the second wall portion planar surface 64 diverge from each other in a direction toward the opening 50.

The first wall portion 54 adjoins the third wall portion 38 and the second wall portion 56 adjoins a fourth wall portion 66. The third wall portion 38 has a third wall portion curved surface 68 and the fourth wall portion 66 has a fourth wall portion curved surface 70. The third wall portion curved surface 68 and the fourth wall portion curved surface 70 converge toward each other in a direction toward the opening 50. Further, the third wall portion curved surface 68 and the fourth wall portion curved surface 70 each comprise a radius of curvature 72, 72*a*. Preferably, the radius of curvature 72 for the third wall portion curved surface 68 and the radius of curvature 72*a* for the fourth wall portion curved surface 70 are equal to each other. In an embodiment, the first radius of curvature 60 is less than the radius of curvature 72 for the third wall portion curved surface 68 and the radius of curvature 72*a* for the fourth wall portion curved surface 70.

The third wall portion 38 adjoins the fifth wall portion 46 and the fourth wall portion 66 adjoins a sixth wall portion 74. The fifth wall portion 46 and the sixth wall portion 74 at least partially define the opening 50. In certain embodiments, the fifth wall portion 46 comprises a fifth wall portion curved surface 76 and the sixth wall portion 74 comprises a sixth wall portion curved surface 78. The fifth wall portion curved surface 76 is attached to the third wall portion 38 and the sixth wall portion curved surface 78 is attached to the fourth wall portion 66. The fifth wall portion 46 may also comprise a fifth wall portion planar surface 80 and the sixth wall portion 74 may also comprises a sixth wall portion planar surface 82. When provided, the fifth wall portion planar surface 80 is attached to the fifth wall portion curved surface 76 and the sixth wall portion planar surface 82 is attached to the sixth wall portion curved surface 78. In this embodiment, the fifth wall portion planar surface 80 and the sixth wall portion planar surface 82 are separated by the opening 50 and in a parallel relationship with each other.

Referring back to FIG. 3, it is preferred that a cooling medium fin 84 is located within each cooling medium flow region 14, 14*a*, 14*b*. The cooling medium fins 84 help support the partition sheets 16, 16*a* and increase the heat transfer rate between the cooling medium and the hot medium. The cooling medium fins 84 may comprise aluminum or an aluminum alloy. The cooling medium fins 84 are preferably corrugated. However, the cooling medium fins may be of any configuration known in the art.

In some embodiments, an end 86 of the first leg 26 and an end 88 of the second leg 28 are spaced apart from the fin 84. In other embodiments, like the one illustrated in FIG. 4, the end 86 of the first leg 26 and the end 88 of the second leg 28 abut a side wall 90 of the fin 84. In this embodiment, the configuration of the cooling medium bar 20 provides a space 92 that separates an end 94 of the fin 84 from the joint 42, which prevents the end 94 of the fin 84 from interfering with the formation of the joint 42.

Advantageously, the embodiments of the heat exchanger 10 described above allow the cooling medium bar 20 to exhibit flexibility and elasticity in response to the thermal and mechanical loads experienced by the heat exchanger 10. More particularly, the first leg 26 and the second leg 28 are configured and intended to elastically deform in response to the thermal and mechanical loads experienced by the heat exchanger 10. The flexibility and elasticity of the legs 26, 28, which is provided by the features described above, reduces the stress experienced by the joints 42, 42*a* between the partition sheets 16, 16*a* and the cooling medium bar 20 attached thereto. As such stresses can result in the formation of cracks in the joints 42, 42*a* and/or the partition sheets 16, 16*a* and said cracks may result in leaks in the heat exchanger, the increased flexibility and elasticity exhibited by the cooling medium bar 20 assists in maintaining the efficiency of the heat exchanger 10.

From the foregoing detailed description, it will be apparent that various modifications, additions, and other alternative embodiments are possible without departing from the true scope and spirit. The embodiments discussed herein were chosen and described to provide the best illustration of the principles of the invention and its practical application to thereby enable one of ordinary skill in the art to use the invention in various embodiments and with various modifications as are suited to the particular use contemplated. As should be appreciated, all such modifications and variations are within the scope of the invention.

The invention claimed is:

1. A heat exchanger, comprising:

one or more hot medium flow regions and one or more cooling medium flow regions; and hot medium bars bordering the one or more hot medium flow regions and cooling medium bars bordering the one or more cooling medium flow regions, wherein at least one cooling medium bar of the cooling medium bars is joined to a pair of partition sheets, the at least one cooling medium bar comprising a base, a first leg, and a second leg, the first leg and the second leg each extending from the base, a cavity provided between the first leg and the second leg and in fluid communication with a first cooling medium flow region of the one or more cooling medium flow regions via an opening provided between the first leg and the second leg, wherein each of said first and second legs comprise a first portion and a second portion, wherein each first portion is attached to the base on an end thereof, wherein each first portion gradually decreases in thickness toward the cooling medium flow region, wherein each second portion has a constant thickness from the first portion entirely to the opening, wherein each second portion is entirely defined by an outer curved surface and an inner curved surface and a planar portion located between the curved surfaces, said planar portions defining said opening, said planar portions being parallel to define a constant width between them.

2. The heat exchanger of claim 1, wherein said first portion has two planar surfaces that diverge from each other from an inner end portion curved surface toward said opening.

3. The heat exchanger of claim 2, wherein the inner end portion curved surface comprises a first radius of curvature and the outer curved surface and the inner curved surface have radi of curvature larger than first radius of curvature.

4. The heat exchanger of claim 1, wherein a hot medium in the one or more hot medium flow regions flows in a first direction and a cooling medium in the one or more cooling medium flow regions flows in a second direction and the first direction and the second direction are different.

5. The heat exchanger of claim 1, wherein the one or more hot medium flow regions comprise a first hot medium flow region and a second hot flow medium flow region, the first hot medium flow region and the second hot flow medium flow region being in a spaced apart and parallel relationship with each other and the first cooling medium flow region being provided between the first hot medium flow region and the second hot flow medium flow region.

6. The heat exchanger of claim 1, wherein the one or more hot medium flow regions and the one or more cooling medium flow regions are in an alternating arrangement.

7. The heat exchanger of claim 1, wherein the base comprises a first surface and a second surface and the first and second surfaces are provided in a parallel relationship with each other.

8. The heat exchanger of claim 1, further comprising fins located within the first cooling medium flow region, wherein an end of the first leg and an end of the second leg are proximate a side wall of the fins.

9. The heat exchanger of claim 1, wherein the first portion is connected to a first surface of a first partition plate by a brazed joint.

10. The heat exchanger of claim 9, further comprising fins located within the first cooling medium flow region, wherein a space separates an end of the fins from the brazed joint.

11. A heat exchanger, comprising:

one or more hot medium flow regions and one or more cooling medium flow regions; and hot medium bars bordering the one or more hot medium flow regions and cooling medium bars bordering the one or more cooling medium flow regions, wherein the at least one cooling medium bar comprises a base, a first leg, and a second leg, the first leg and the second leg each extend from the base, a cavity provided between the first leg and the second leg and in fluid communication with a first cooling medium flow region of the one or more cooling medium flow regions via an opening provided between the first leg and the second leg, wherein each of said first and second legs comprise a first portion and a second portion, wherein each first portion is attached to the base on an end thereof, wherein each first portion gradually decreases in thickness toward the cooling medium flow region, wherein each second portion has a constant thickness from the first portion entirely to the opening, wherein each second portion is entirely defined by an outer curved surface and an inner curved surface and a planar portion located between the curved surfaces, said planar portions defining said opening, said planar portions being parallel to define a constant width between them.

12. The heat exchanger of claim 11, wherein within said first portion, said cavity is only defined by an inner end curved surface with only upper and lower planar inner surfaces extending therefrom to said second portion, wherein said upper and lower planar inner surfaces diverge from one another from said inner end curved surface to said second portion.

13. The heat exchanger of claim 12, wherein said inner curved surface and said outer curved surface both have radii of curvature larger than a radius of curvature of said inner end curved surface.

* * * * *